US010539049B2

(12) United States Patent
Yamakawa et al.

(10) Patent No.: US 10,539,049 B2
(45) Date of Patent: Jan. 21, 2020

(54) VALVE OPENING/CLOSING TIMING CONTROL DEVICE

(71) Applicant: AISIN SEIKI KABUSHIKI KAISHA, Kariya-shi, Aichi-ken (JP)

(72) Inventors: Yoshiaki Yamakawa, Novi, MI (US); Masaki Kobayashi, Okazaki (JP)

(73) Assignee: AISIN SEIKI KABUSHIKI KAISHA, Kariya-Shi, Aichi-Ken (JP)

( * ) Notice: Subject to any disclaimer, the term of this patent is extended or adjusted under 35 U.S.C. 154(b) by 43 days.

(21) Appl. No.: 15/825,980

(22) Filed: Nov. 29, 2017

(65) Prior Publication Data

US 2018/0156079 A1 Jun. 7, 2018

(30) Foreign Application Priority Data

Dec. 2, 2016 (JP) ..... 2016-235221

(51) Int. Cl.
*F01L 1/344* (2006.01)

(52) U.S. Cl.
CPC ... *F01L 1/3442* (2013.01); *F01L 2001/34426* (2013.01); *F01L 2001/34453* (2013.01)

(58) Field of Classification Search
CPC ..... F01L 1/3442; F01L 2001/34426; F01L 2001/3443; F01L 2001/34433; F01L 2001/34453; F01L 2001/34463; F01L 2001/34473; F01L 2250/02
USPC ..... 123/90.15
See application file for complete search history.

(56) References Cited

U.S. PATENT DOCUMENTS 9,708,939 B2 * 7/2017 Kobayashi ..... F01L 1/3442
2009/0159024 A1 6/2009 Paul et al.
2017/0241302 A1 * 8/2017 Haltiner, Jr. ..... F01L 1/3442

FOREIGN PATENT DOCUMENTS

JP 2015-78635 A 4/2015
JP 2015078625 A * 4/2015

OTHER PUBLICATIONS

U.S. Appl. No. 15/826,133, filed Nov. 29, 2017, Yoshiaki Yamakawa et al.

* cited by examiner

*Primary Examiner* — Phutthiwat Wongwian
*Assistant Examiner* — Kelsey L Stanek
(74) *Attorney, Agent, or Firm* — Buchanan Ingersoll & Rooney PC

(57) ABSTRACT

A valve opening/closing timing control device includes: a driving side rotator synchronously rotating with a crankshaft of an internal combustion engine; a driven side rotator coaxially disposed with a rotation axis of the driving side rotator and integrally rotating with a valve opening/closing camshaft; advance and retard chambers formed between the driving side and driven side rotators; a lock mechanism including a lock member capable of engaging with a recessed portion formed on one of the driving side and driven side rotators, and provided in the other of the driving side and driven side rotators; and a connecting bolt coaxially disposed with the rotation axis and connecting the driven side rotator to the camshaft, in which the connecting bolt includes an internal space, a valve unit accommodates a spool, and the spool includes an internal flow path, and, in the spool, a lock holding check valve is disposed.

18 Claims, 8 Drawing Sheets

| | PA1 | PA2 | PN | PB2 | PB1 |
|---|---|---|---|---|---|
| ADVANCE CHAMBER | SUPPLY | SUPPLY | INTERRUPT | DISCHARGE | DISCHARGE |
| RETARD CHAMBER | DISCHARGE | DISCHARGE | INTERRUPT | SUPPLY | SUPPLY |
| LOCK MEMBER | DISCHARGE | SUPPLY | SUPPLY | SUPPLY | DISCHARGE |

VALVE OPENING/CLOSING TIMING CONTROL DEVICE

CROSS REFERENCE TO RELATED APPLICATIONS

This application is based on and claims priority under 35 U.S.C. § 119 to Japanese Patent Application 2016-235221, filed on Dec. 2, 2016, the entire contents of which are incorporated herein by reference.

TECHNICAL FIELD

This disclosure relates to a valve opening/closing timing control device which controls a relative rotation phase between a driving side rotator and a driven side rotator by a fluid pressure and holds the relative rotation phase at a predetermined phase by a lock mechanism.

BACKGROUND DISCUSSION

As the above-described valve opening/closing timing control device, JP 2015-78635A (Reference 1) discloses a technology in which a spool is coaxially disposed with a rotation axis, a relative rotation phase is controlled in an advance direction and a retard direction by operating the spool in a direction along the rotation axis, and thus, a lock mechanism is shifted to a locked state by setting the spool to an operation end in the advance direction and an operation end in the retard direction.

In Reference 1, a check valve is provided in a flow path through which a fluid is supplied to the spool, and thus, this check valve can prevent the fluid from flowing to a hydraulic pump side.

As described in Reference 1, the single spool is coaxially provided with the rotation axis of the valve opening/closing timing control device, and when controls of supplying and discharging the fluid with respect to an advance chamber and a retard chamber are performed by operating the spool, in a situation where the state is an unlocked state, for example, in a case where the fluid is supplied to the advance chamber when straddling a lock groove, a supply pressure of the fluid with respect to the valve opening/closing timing control device is decreased by supplying a working oil to the advance chamber, a lock release pressure acting on the lock mechanism decreases, and thus, it is considered that the lock mechanism is shifted to the locked state.

In the lock mechanism, a recessed portion is formed in one of a driving side rotator and a driven side rotator, a lock member which can engage with the recessed portion is supported by the other thereof, and an urging force generated by a spring by which the lock member engages with the recessed portion acts on the lock member. In the above-described configuration, in a case where an unlocked state of the lock mechanism is maintained, it is necessary to continuously supply the fluid to the lock member.

In a case where a valve unit is configured to include the single spool, an advance port communicating with the advance chamber, a retard port communicating with the retard chamber, and a lock port communicating with the lock member are disposed to be positioned so as to be close to each other. For example, in a case where the spool is operated to an advance position to perform an advance operation from a situation where the spool is positioned at a neutral position and a fluid pressure acts on the lock port, the fluid is supplied to the advance port, and thus, the fluid pressure of the lock port decreases. Therefore, it is considered that the lock member unintentionally engages with a lock recessed portion. Here, in a case where an intermediate lock mechanism is provided, it is necessary to change a phase across an intermediate lock recessed portion. Accordingly, compared with a configuration in which the most retarded lock mechanism or the most advanced lock mechanism is provided, a phenomenon of being erroneously shifted to a locked state easily occurs, and thus, it is necessary to prevent this phenomenon.

In order to suppress the above-described inappropriate operations, for example, it is also considered that a fluid pressure continuously acts on the lock mechanism even when a relative rotation phase is controlled by individually providing a phase control hydraulic valve for controlling a working oil supplied to or discharged from the advance chamber and the retard chamber and a lock control hydraulic valve for controlling the lock mechanism. However, in this configuration, two hydraulic valves are required, and thus, the number of parts increases, a configuration of an oil passage is complicated, and a size of the configuration increases.

Thus, a need exists for a valve opening/closing timing control device which is not susceptible to the drawback mentioned above.

SUMMARY

A feature of an aspect of this disclosure resides in that valve opening/closing timing control device includes: a driving side rotator which synchronously rotates with a crankshaft of an internal combustion engine; a driven side rotator which is coaxially disposed with a rotation axis of the driving side rotator and integrally rotates with a valve opening/closing camshaft; an advance chamber and a retard chamber which are formed between the driving side rotator and the driven side rotator; a lock mechanism which includes a lock member capable of engaging with a recessed portion formed on one of the driving side rotator and the driven side rotator, and provided in the other of the driving side rotator and the driven side rotator; and a connecting bolt which is coaxially disposed with the rotation axis and connects the driven side rotator to the camshaft, in which the connecting bolt includes an internal space which is coaxially formed with the rotation axis, and an advance port communicating with the advance chamber, a retard port communicating with the retard chamber, and a lock port communicating with the recessed portion are formed as through-holes connecting the internal space and an outer periphery to each other, a valve unit configured to accommodate a spool to be movable in a direction along the rotation axis in the internal space of the connecting bolt, and the spool includes an internal flow path through which a fluid is supplied about the rotation axis, and, in the spool, a lock holding check valve suppressing a backflow of a working oil from the lock port is disposed between a first supply point at which the fluid is capable of being supplied from the internal flow path to the advance port and the retard port and a second supply point at which the fluid is capable of being supplied to the lock port on a downstream side of the first supply point in a supply direction of the fluid.

BRIEF DESCRIPTION OF THE DRAWINGS

The foregoing and additional features and characteristics of this disclosure will become more apparent from the following detailed description considered with the reference to the accompanying drawings, wherein.

DETAILED DESCRIPTION

Hereinafter, an embodiment disclosed here will be described with reference to the drawings.

Basic Configuration

Figure 1:
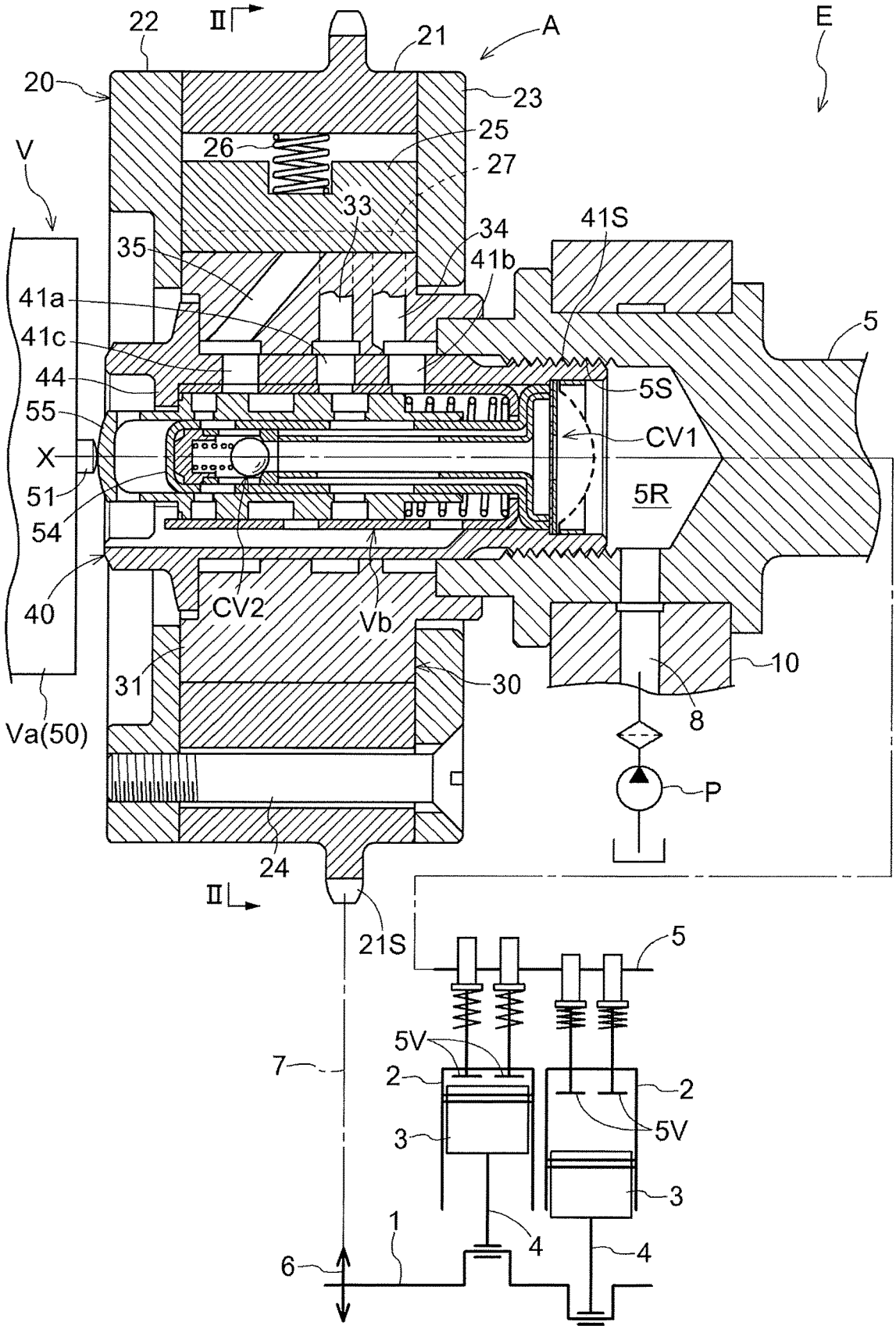
FIG. 1 is a sectional view showing a valve opening/closing timing control device.
Figures 2, 3:
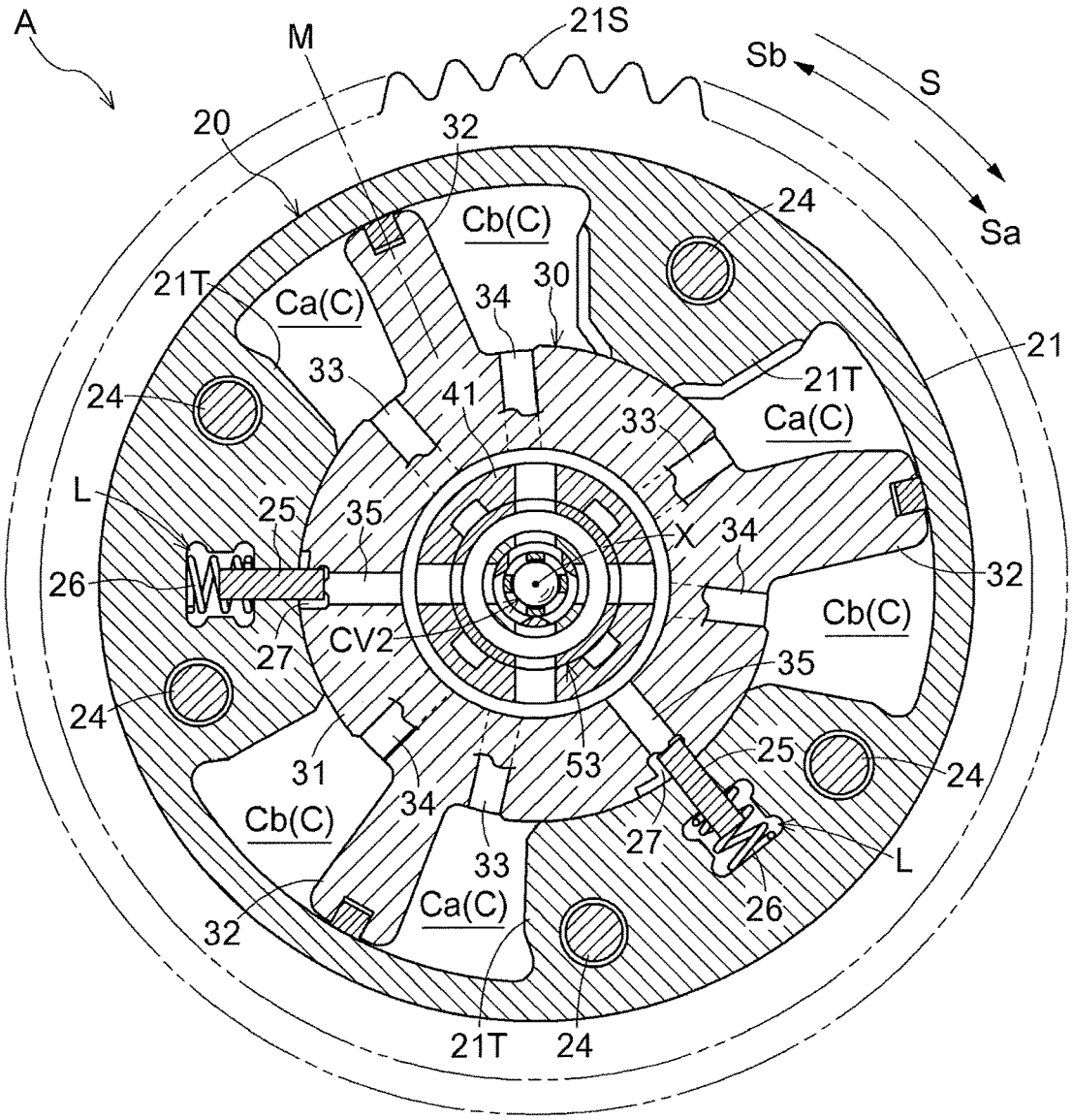
FIG. 2 is a sectional view taken along line II-II of FIG. 1.
FIG. 3 is a table listing a relationship between a position of a spool and supply and discharge of a working oil.

As shown in FIGS. 1 and 2, a valve opening/closing timing control device A is configured to include an external rotor 20 which is a driving side rotator, an internal rotor 30 which is a driven side rotator, and an electromagnetic control valve V for controlling a working oil which is a working fluid.

This valve opening/closing timing control device A is coaxially provided with a rotation axis X of an intake camshaft 5 to set an opening and closing timing of the intake camshaft 5 of an engine E (an example of an internal combustion engine) of a vehicle such as a passenger car.

The internal rotor 30 (an example of the driven side rotator) is coaxially disposed with the rotation axis X of the intake camshaft 5 and is connected to the intake camshaft 5 by a connecting bolt 40 to be integrally rotated with the intake camshaft 5. The external rotor 20 encloses the internal rotor 30, and the external rotor 20 (an example of the driving side rotator) is coaxially disposed with the rotation axis X and synchronously rotates with a crankshaft 1 of the engine E. From this configuration, the external rotor 20 and the internal rotor 30 can rotate relative to each other.

The valve opening/closing timing control device A includes a lock mechanism L which holds a relative rotation phase between the external rotor 20 and the internal rotor 30 at an intermediate lock phase M shown in FIG. 2. This intermediate lock phase M is an opening and closing timing suitable for starting the engine E, and a control shifted to the intermediate lock phase M is performed when a control for stopping the engine E is performed.

The electromagnetic control valve V includes an electromagnetic unit Va and a valve unit Vb which are supported by the engine E. The valve unit Vb includes the connecting bolt 40 and a spool 55 which is accommodated in an internal space 40R of the connecting bolt 40.

The electromagnetic unit Va includes a solenoid portion 50 and a plunger 51 which is coaxially disposed with the rotation axis X and is operated to move forward and backward by controlling driving of the solenoid portion 50. In the valve unit Vb, the spool 55 which controls supply and discharge of the working oil (an example of a working fluid) is coaxially disposed with the rotation axis X and positional relationships are set such that a protrusion end of the plunger 51 abuts on an outer end of the spool 55.

The electromagnetic control valve V sets a protrusion amount of the plunger 51 by controlling power supplied to the solenoid portion 50 to operate the spool 55. According to this operation of the spool 55, the flow of the working oil is controlled to set an opening and closing timing of an intake valve 5V, and thus, switching between a locked state of the lock mechanism L and an unlocked state thereof is performed. The configuration of the electromagnetic control valve V and the control aspect of the working oil will be described below.

Engine and Valve Opening/Closing Timing Control Device

As shown in FIG. 1, the engine E is configured of a four-cycle type engine in which pistons 3 are accommodated in cylinder bores of cylinder blocks 2 positioned at the upper position of the engine E and the pistons 3 and the crankshaft 1 are connected to each other by connecting rods 4. In the upper portion of the engine E, the intake camshaft 5 which opens and closes the intake valves 5V and an exhaust camshaft (not shown) are provided.

A supply flow path 8 through which the working oil form a hydraulic pump P driven by the engine E is supplied is formed in an engine configuration member 10 which rotatably supports the intake camshaft 5. The hydraulic pump P supplies a lubricant stored in an oil pan of the engine E to the valve unit Vb through the supply flow path 8 as the working oil (an example of a working fluid).

A timing chain 7 is wound around an output sprocket 6 formed on the crankshaft 1 of the engine E and a timing sprocket 21S of the external rotor 20. Accordingly, the external rotor 20 synchronously rotates with the crankshaft 1. A sprocket is also provided on a front end of an exhaust camshaft on an exhaust side and the timing chain 7 is wound around this sprocket.

As shown in FIG. 2, the external rotor 20 rotates in a driving rotation direction S by a driving force from the crankshaft 1. A direction in which the internal rotor 30 rotates relative to the external rotor 20 in the same direction as the driving rotation direction S is referred to an advance direction Sa, and a direction opposite to the advance direction Sa is referred to as a retard direction Sb. In the valve opening/closing timing control device A, a relationship between the crankshaft 1 and the intake camshaft 5 is set such that an intake compression ratio increases according to an increase of a displacement amount when the relative rotation phase is displaced in the advance direction Sa and the intake compression ratio decreases according to the increase of the displacement amount when the relative rotation phase is displaced in the retard direction Sb.

In this embodiment, the case where the valve opening/closing timing control device A is provided in the intake camshaft 5 is shown. However, the valve opening/closing timing control device A may be provided in the exhaust camshaft or may be provided in both the intake camshaft 5 and the exhaust camshaft.

External Rotor and Internal Rotor

As shown in FIG. 1, the external rotor 20 includes an external rotor body 21, a front plate 22, and a rear plate 23, and the external rotor body 21, the front plate 22, and the rear plate 23 are integrated by fastening a plurality of fastening bolts 24. A timing sprocket 21S is formed on an outer periphery of the external rotor body 21.

As shown in FIG. 2, a plurality of protrusion portions 21T protruding radially inward are integrally formed with the external rotor body 21. The internal rotor 30 includes a columnar internal rotor body 31 which is in close contact with the protrusion portions 21T of the external rotor body 21 and a plurality of vane portions 32 which protrudes radially outward from the outer periphery of the internal rotor body 31 to be in contact with the inner peripheral surface of the external rotor body 21.

In this way, the external rotor 20 encloses the internal rotor 30, and a plurality of fluid pressure chambers C are formed on the outer peripheral side of the internal rotor body 31 at intermediate positions of the adjacent protrusion portions 21T in the rotation direction. Each of the fluid pressure chambers C is partitioned by the vane portion 32 and thus, the fluid pressure chamber C is divided into an advance chamber Ca and a retard chamber Cb. An advance flow path 33 communicating with the advance chamber Ca and a retard flow path 34 communicating with the retard chamber Cb are formed in the internal rotor body 31.

As shown in FIGS. 1 and 2, the lock mechanism L includes a lock member 25 which is supported to move forward and backward in the radial direction with respect to each of two protrusion portions 21T of the external rotor 20, a lock spring 26 which protrudes to urge the lock member 25, and a lock recessed portion 27 which is formed on the outer periphery of the internal rotor body 31. A lock control flow path 35 which communicates with the lock recessed portion 27 is formed in the internal rotor body 31.

Two lock members 25 simultaneously engage with the corresponding lock recessed portions 27 by urging forces of the lock spring 26, and thus, the lock mechanism L functions to regulate the relative rotation phase to the intermediate lock phase M. In this locked state, by supplying the working oil to the lock control flow paths 35, the lock members 25 are disengaged from the lock recessed portions 27 against the urging forces of the lock springs 26, and thus, the locked state can be released. Conversely, by discharging the working oil from the lock control flow paths 35, the lock members 25 engage with the lock recessed portions 27 by the urging forces of the lock springs 26, and thus, the state can be shifted to the locked state.

The lock mechanism L may be configured such that a single lock member 25 engages with the corresponding single lock recessed portion 27. The lock mechanism L may be configured such that the lock member 25 is guided to move in the direction along the rotation axis X.

Connecting Bolt

Figure 4:
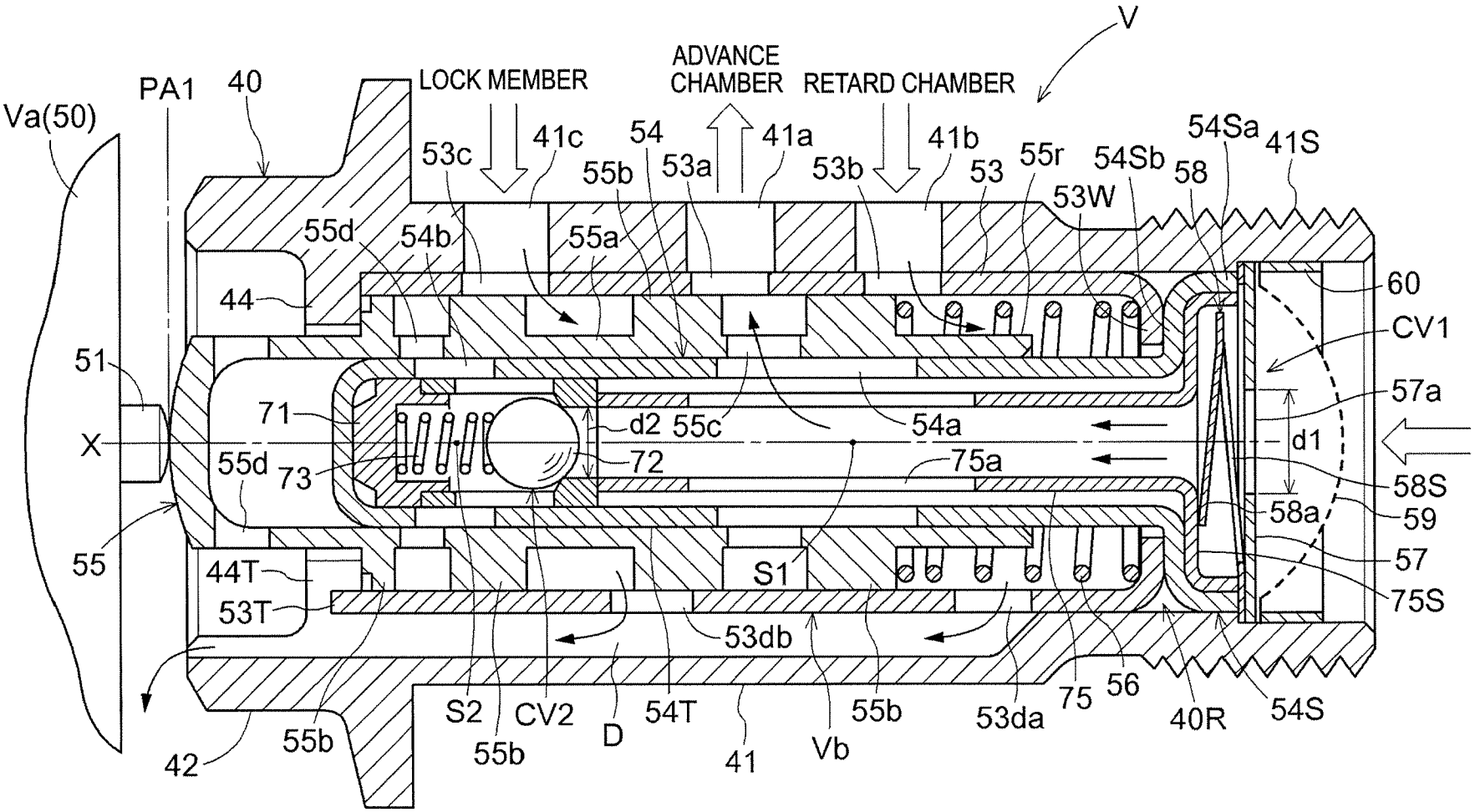
FIG. 4 is a sectional view of a valve unit in which the spool is positioned at a first advance position.
Figure 9:
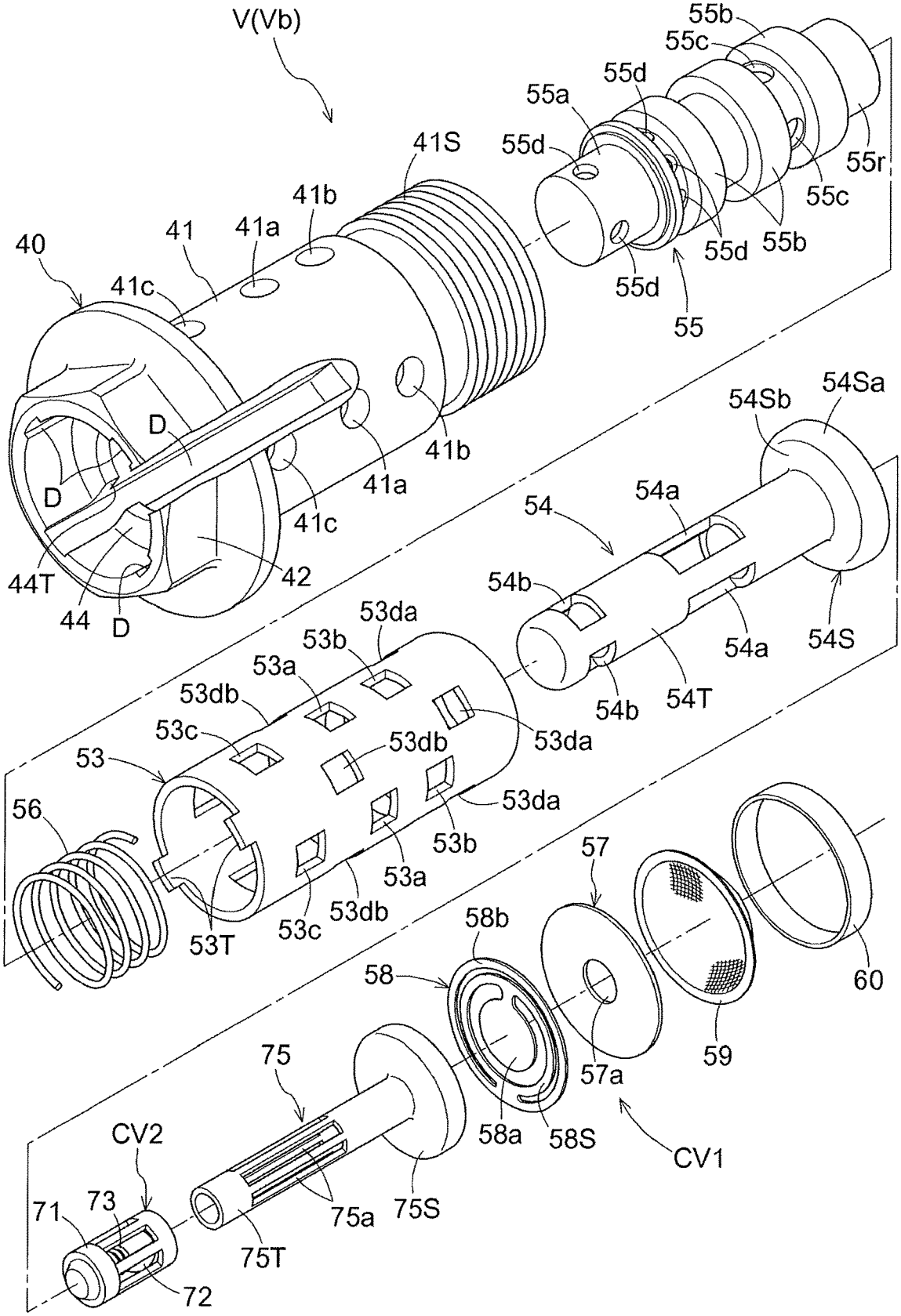
FIG. 9 is an exploded perspective view of the valve unit.

As shown in FIGS. 1, 4, and 9, in the connecting bolt 40, a bolt body 41 which is generally formed in a tubular shape and a bolt head portion 42 on an outer end portion (left side in FIG. 4) are integrally formed to each other. The internal space 40R penetrating in the direction along the rotation axis X is formed inside the connecting bolt 40, and a male screw portion 41S is formed on the outer periphery of the inner end portion of the bolt body 41.

As shown in FIG. 1, a shaft inner space 5R is formed about the rotation axis X in the intake camshaft 5, and a female screw portion 5S is formed on the inner periphery of the shaft inner space 5R. The shaft inner space 5R communicates with the supply flow path 8, and thus, the working oil is supplied to the shaft inner space 5R from the hydraulic pump P.

From this configuration, the bolt body 41 is inserted into the internal rotor 30, the male screw portion 41S of the bolt body 41 is screwed to the female screw portion 5S of the intake camshaft 5, and the internal rotor 30 is fastened to the intake camshaft 5 by rotating the bolt head portion 42. The internal rotor 30 is fastened and fixed to the intake camshaft 5 by this fastening, and the shaft inner space 5R communicates with the internal space 40R (strictly, the space inside the fluid supply pipe 54) of the connecting bolt 40.

A regulating wall 44 which is a wall portion protruding in a direction approaching the rotation axis X is formed on the outer end side of the inner peripheral surface of the internal space 40R of the connecting bolt 40 in the direction along the rotation axis X. A plurality of (four) drain grooves D (example of drain flow path) are formed along the rotation axis X in a region from an intermediate position on the inner periphery of the connecting bolt 40 to the tip. Accordingly, engagement recessed portions 44T are formed at portions in which the regulating wall 44 overlaps the four drain grooves D.

In the bolt body 41, an advance port 41*a* communicating with each of the advance flow paths 33, a retard port 41*b* communicating with each of the retard flow paths 34, and a lock port 41*c* communicating with each of the lock control flow paths 35 are formed as through-holes which connect the internal space 40R and the outer peripheral surface of the bolt body 41 to each other.

An end portion (left end portion in FIG. 4) on an outer end side of a sleeve 53 described later abuts on the regulating wall 44, and thus, the position of the sleeve 53 is regulated. In addition, land portions 55*b* described later of the spool 55 abut on the regulating wall 44, and thus, the position on the protrusion side of each of the land portions 55*b* is regulated.

Valve Unit

As shown in FIGS. 1, 4, and 9, the valve unit Vb includes the sleeve 53 which is fitted in a state of being in close contact with the connecting bolt 40 and the inner peripheral surface of the bolt body 41, the fluid supply pipe 54 which is accommodated in the internal space 40R coaxially with the rotation axis X, and the spool 55 which is disposed to be slidingly movable in the direction along the rotation axis X in a state of being guided by the inner peripheral surface of the sleeve 53 and the outer peripheral surface of the pipeline portion 54T of the fluid supply pipe 54.

The valve unit Vb includes a spool spring 56 which is an urging member urging the spool 55 in the protrusion direction, a first check valve CV1 (an example of a main check valve), an oil filter 59, and a fixing ring 60. A second check valve CV2 (an example of a lock holding check valve) is provided inside the fluid supply pipe 54, and a regulating member 75 is provided inside the fluid supply pipe 54. That is, the first check valve CV1 is disposed at a position (upstream side) at which the supply with respect to the fluid supply pipe 54 starts, and the second check valve CV2 is disposed on the downstream side of the first check valve CV1.

As shown in FIG. 9, the first check valve CV1 includes an opening plate 57 and a valve plate 58 which are formed of metal plates having the same outer diameter as each other. A circular opening portion 57*a* about the rotation axis X is formed at the center position of the opening plate 57. In the valve plate 58, a circular valve body 58*a* having a larger diameter than that of the above-described opening portion 57*a* is disposed at the center position of the valve plate 58, an annular portion 58*b* is disposed on the outer periphery of the valve plate 58, and a spring portion 58S which connects the valve body 58*a* and the annular portion 58*b* to each other is provided.

In the first check valve CV1, in a case where a pressure on the downstream side of the first check valve CV1 increases or in a case where a discharge pressure of the hydraulic pump P decreases, the valve body 58*a* comes into close contact with the opening plate 57 by the urging force of the spring portion 58S to close the opening portion 57*a*.

The oil filter 59 is configured to include a filtering portion having a mesh member of which a center portion having the same outer diameter as those of the opening plate 57 and the valve plate 58 expands toward the upstream side in the supply direction of the working oil. The fixing ring 60 is press-fitted and fixed to the inner periphery of the connecting bolt 40, and the positions of the oil filter 59, the opening plate 57, and the valve plate 58 in the direction of the rotation axis X are determined by the fixing ring 60.

Valve Unit: Sleeve

As shown in FIGS. 1, 4, and 9, the sleeve 53 is formed in a tubular shape about the rotation axis X, and in the sleeve 53, a plurality of (two) engagement protrusions 53T protruding in the direction along the rotation axis X are formed on the outer end side (left side in FIGS. 4 and 9) of the sleeve 53, the inner end side (right side in FIG. 4) of the sleeve 53 is bent to be orthogonal to the rotation axis X, and thus, an end wall 53W is formed by drawing or the like.

The regulation wall 44 is formed in an annular region. Meanwhile, the four engagement recessed portions 44T are formed by notching the portions corresponding to the drain grooves D.

In the sleeve 53, a plurality of advance communication hole 53*a* causing the advance ports 41*a* to communicate with the internal space 40R, a plurality of retard communication hole 53*b* causing the retard ports 41*b* to communicate with the internal space 40R, and a plurality of lock communication hole 53*c* causing the lock ports 41*c* to communicate with the internal space 40R are formed. In the sleeve 53, first drain holes 53*da* are formed on the inner end side, and second drain holes 53*db* are formed on the outer end side from the first drain holes 53*da*.

The advance communication holes 53*a*, the retard communication holes 53*b*, and the lock communication holes 53*c* are each formed to be arranged in the direction along the rotation axis X at four locations in a circumferential direction about the rotation axis X. The first drain holes 53*da* and the second drain holes 53*db* are each formed in phases different from those of the advance communication holes 53*a*, the retard communication holes 53*b*, and the lock communication holes 53*c* at four locations in the circumferential direction about the rotation axis X.

The above-described engagement protrusions 53T are disposed on the extension line in the direction along the rotation axis X at the same phase as those of the drain holes positioned at two locations facing each other in a state where the rotation axis X is interposed therebetween among the first drain holes 53*da* and the second drain holes 53*db* formed at the four locations.

From this configuration, the engagement protrusions 53T engage with the engagement recessed portions 44T of the regulating wall 44, and the sleeve 53 is fitted in a state where the front end edge of the sleeve 53 abuts on the regulating wall 44.

The advance communication holes 53*a* communicate with the advance ports 41*a*, the retard communication holes 53*b* communicate with the retard ports 41*b*, and the lock communication holes 53*c* communicate with the lock ports 41*c*. The first drain holes 53*da* and the second drain holes 53*db* communicate with the drain groove D.

Valve Unit: Fluid Supply Pipe

As shown in FIGS. 4 and 9, in the fluid supply pipe 54, a base end portion 54S fitted into the internal space 40R and the pipeline portion 54T having a smaller diameter than that of the base end portion 54S are integrally formed, a plurality of (three) first supply ports 54*a* are formed at a position close to the base end portion 54S on the outer periphery on the tip portion of the pipeline portion 54T, and a plurality of (three) second supply ports 54*b* are formed on the outer end side than the first supply ports 54*a*.

The base end portion 54S includes a fitting tubular portion 54Sa about the rotation axis X and an intermediate wall 54Sb which is formed in a region from the fitting tubular portion 54Sa to the pipeline portion 54T and is orthogonal to the rotation axis X.

The three first supply ports 54*a* are wide in the circumferential direction and elongated in the direction along the rotation axis X, and four intermediate hole portions 55*c* which are formed in the spool 55 at the positions corresponding to the first supply ports 54*a* are each formed in a circular shape. From this configuration, it is possible to reliably supply the working oil from the pipeline portion 54T to the intermediate hole portions 55*c*.

Similarly to the first supply ports 54*a*, the second supply ports 54*b* extend in the direction along the rotation axis X, and four end hole portions 55*d* formed in the spool 55 at the positions corresponding to the second supply ports 54*b* are each formed in a circular shape. From this configuration, it is possible to reliably supply the working oil from the pipeline portion 54T to the end hole portions 55*d*.

The second check valve CV2 preventing a backflow of the working oil from the lock ports 41*c* is provided in the internal flow path of the fluid supply pipe 54, and a regulating member 75 determining the position of the second check valve CV2 is provided.

In the second check valve CV2, a ball-shaped valve member 72 and a ball spring 73 urging the valve member 72 in a close direction are accommodated inside a valve case 71, and a plurality of openings are formed on an outer periphery of the valve case 71. In the regulating member 75, a disk-shaped support 75S on the base end side and a tubular body 75T are integrally formed, and a plurality of slit-shaped portions 75*a* are formed in the tubular body 75T. In the second check valve CV2, an inner diameter of a portion of the valve case 71 which receives the valve member 72 and an inner diameter of the tubular body 75T of the regulating member 75 are set to the same value as each other.

That is, in the internal flow path of the spool 55, a first supply point S1 at which the working oil can be supplied to the advance ports 41*a* and the retard ports 41*b* is set, and a second supply point S2 at which the working oil is supplied to the lock port 41*c* on the downstream side of the first supply point S1 in the flow direction of the working oil is set. The second check valve CV2 is disposed between the first supply point S1 and the second supply point S2 set as described above.

Accordingly, in a case where the working oil is supplied to the advance chamber Ca or the retard chamber Cb, even when the pressure of the working oil of the first supply point S1 decreases, the second check valve CV2 is closed by the decrease of the pressure. Therefore, the backflow of the working oil from the lock ports 41*c* is prevented, and a locked state of the lock mechanism L can be maintained.

In the valve unit Vb, an opening area of the opening portion 57*a* of the opening plate 57 is a flow path cross-sectional area of the first check valve CV1, and an opening area of the portion of the valve case 71 of the second check valve CV2 receiving the valve member 72 is a flow path cross-sectional area of the second check valve CV2.

As shown in FIG. 4, an opening diameter of the opening portion 57*a* is referred to as a first diameter d1, and a corresponding diameter of the portion of the valve case 71 of the second check valve CV2 passing through the valve member 72 is referred to as a second diameter d2. As shown in FIG. 4, the first diameter d1 is larger than the second diameter d2, and thus, the flow path cross-sectional area of the first check valve CV1 is set to a value which is larger than that of the flow path cross-sectional area of the second check valve CV2.

From this configuration, it is possible to supply a sufficient amount of fluid via the first check valve CV1 (main check valve) during an advance operation or a retard operation. The flow path cross-sectional area of the second check valve CV2 (lock holding check valve) is smaller than the flow path cross-sectional area of the first check valve CV1, and therefore it is possible to hold the locked state while suppressing an increase in a size of the lock holding check valve.

Valve Unit: Spool and Spool Spring

As shown in FIGS. 4 and 9, in the spool 55, a spool body 55*a* which is formed in a tubular shape and has an abutment surface formed on the outer end side, and four land portions 55*b* which are formed on the outer periphery to protrude are formed. The internal flow path is formed inside the spool 55, the plurality of (four) intermediate hole portions 55*c* communicating with the internal flow path are formed at an intermediate position between a pair of land portions 55*b* on the inner end side in the direction along the rotation axis X, and the end hole portions 55*d* communicating with the internal flow path are formed at an intermediate position between a pair of land portions 55*b* on the outer end side in the direction along the rotation axis X.

In the spool 55, an abutment end portion 55*r*, which abuts on the end wall 53W and determines the operation limit when the spool 55 is operated in a pushing-in direction, is formed on a side opposite to the abutment surface. The abutment end portion 55*r* is provided on the end portion of the region in which the spool body 55*a* extends and prevents the spool 55 from operating over the operation limit even when the spool 55 is pushed-in by an excessive force. In order to determine the operation limit when the spool 55 is operated in the pushing-in direction, a configuration may be adopted in which the inner surface on the outer end side (the inner end on the left side of the FIG. 4) of the spool 55 and the end portion on the protrusion side (the outer end on the left side of FIG. 4) of the fluid supply pipe 54 abut on each other when the spool 55 is operated in the pushing-in direction.

The spool spring 56 is a compression coil type spring and is disposed between the land portion 55*b* on the inner end side and the end wall 53W of the sleeve 53. In a case where power is not supplied to the solenoid portion 50 of the electromagnetic unit Va by the urging force of the spool spring 56, the land portion 55*b* on the outer end side abuts on the regulating wall 44, and the spool 55 is maintained at a first advance position PM shown in FIG. 4.

In the valve unit Vb, a positional relationship is set such that the end wall 53W of the sleeve 53 and the intermediate wall 54Sb of the fluid supply pipe 54 abut on each other, and it is possible to suppress the flow of the working oil by increasing planar accuracy between the end wall 53W and the intermediate wall 54Sb abutting on each other.

That is, in this configuration, the position of the base end portion 54S of the fluid supply pipe 54 is fixed by the fixing ring 60, and thus, the base end portion 54S functions as a retainer. The urging force of the spool spring 56 acts on the end wall 53W of the sleeve 53, and thus, the end wall 53W is in pressure contact with the intermediate wall 54Sb of the base end portion 54S. Accordingly, the end wall 53W is in close contact with the intermediate wall 54Sb using the urging force of the spool spring 56, and thus, it is possible to prevent leakage of the working oil at this portion.

Detail of Valve Unit

From the above-described configurations, in a case where the valve unit Vb is assembled, the spool spring 56 and the spool 55 are inserted into the sleeve 53, and this sleeve 53 is inserted into the internal space 40R of the connecting bolt 40. During this insertion, the engagement protrusions 53T of the sleeve 53 engage with the engagement recessed portions 44T of the regulating wall 44, and thus, a relative rotation posture between the connecting bolt 40 and the sleeve 53 about the rotation axis X is determined.

Next, the fluid supply pipe 54 is disposed such that the pipeline portion 54T of the fluid supply pipe 54 is inserted into the inner periphery of the spool body 55*a* of the spool 55, the second check valve CV2 is inserted into the fluid supply pipe 54, and the regulating member 75 is inserted. Accordingly, the base end portion 54S of the fluid supply pipe 54 is positioned to be fitted into the inner peripheral wall of the internal space 40R of the connecting bolt 40, and the support 75S of the regulating member 75 is positioned to be fitted into the base end portion 54S.

In this positional relationship, the opening plate 57 and the valve plate 58 configuring the first check valve CV1 are disposed to overlap each other, the oil filter 59 is disposed in the internal space 40R to further overlap the overlapped opening plate 57 and valve plate 58, and the fixing ring 60 is fitted and fixed to the inner periphery of the internal space 40R.

In this way, according to the fixing of the fixing ring 60, the outer end portion of the sleeve 53 abuts on the regulating wall 44, the position in the direction along the rotation axis X is determined, and the position of the second check valve CV2 is determined. Instead of the fixing ring 60, the position of the second check valve CV2 or the like may be determined using a snap ring.

Operation Aspect

In the valve opening/closing timing control device A, in a state where power is not supplied to the solenoid portion 50 of the electromagnetic unit Va, a pressing force from the plunger 51 does not act on the spool 55, and as shown in FIG. 4, the position of the spool 55 is maintained by the urging force of the spool spring 56 in a state where the land portions 55*b* at the outer side position of the spool 55 abut on the regulating wall 44.

This position of the spool 55 is the first advance position PA1. By increasing the power supplied to the solenoid portion 50 of the electromagnetic unit Va, as shown in FIG. 3, a second advance position PA2, a neutral position PN, a second retard position PB2, and a first retard position PB1 can be operated in this order. That is, the spool 55 can be operated to any one position of the five positions by setting power supplied to the solenoid portion 50 of the electromagnetic unit Va. In a case where the spool 55 is operated to the first retard position PB1, the power supplied to the solenoid portion 50 is the maximum.

In a case where the spool 55 is operated to any one of the first advance position PA1 and the second advance position PA2, the working oil supplied from the hydraulic pump P is fed to the advance port 41*a* via the intermediate hole portions 55*c* of the spool 55 and the advance communication holes 53*a* and the working oil is supplied from the advance flow paths 33 to the advance chambers Ca. At the same time, the working oil from the retard chambers Cb flows from the retard flow paths 34 to the retard ports 41*b* and is discharged from the first drain holes 53*da* to the drain grooves D.

Particularly, in the first advance position PA1, as shown in FIG. 4, the working oil of the lock recessed portions 27 flows the lock control flow paths 35 to the lock ports 41*c* in conjunction with the supply of the working oil to the advance chambers Ca and is discharged from the second drain holes 53*db* to the drain grooves D. According to the supply and discharge of the working oil, the lock mechanism L is shifted to the locked state when the relative rotation phase reaches the intermediate lock phase M while the relative rotation phase is displaced in the advance direction Sa.

Figure 5:
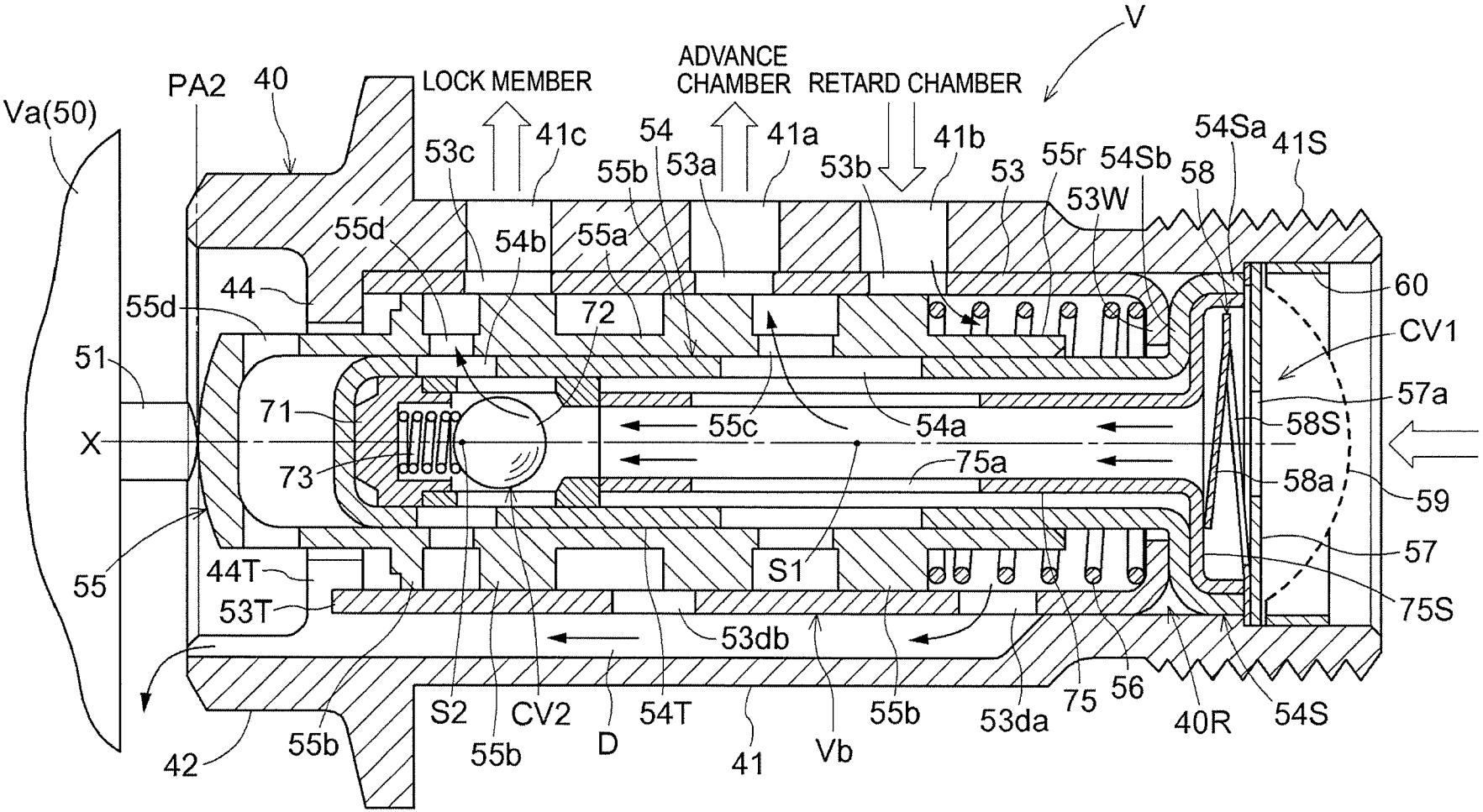
FIG. 5 is a sectional view of the valve unit in which the spool is positioned at a second advance position.

In the second advance position PA2, as shown in FIG. 5, the working oil passes the second check valve CV2 in conjunction with the supply of the working oil to the advance chambers Ca and is supplied from the lock ports 41*c* to the recessed portions 27 via the lock control flow paths 35. Accordingly, the pressure of the working oil continuously acts on the lock members 25, and the operation in the advance direction Sa is performed in a state where the lock mechanism L is unlocked.

Figure 6:
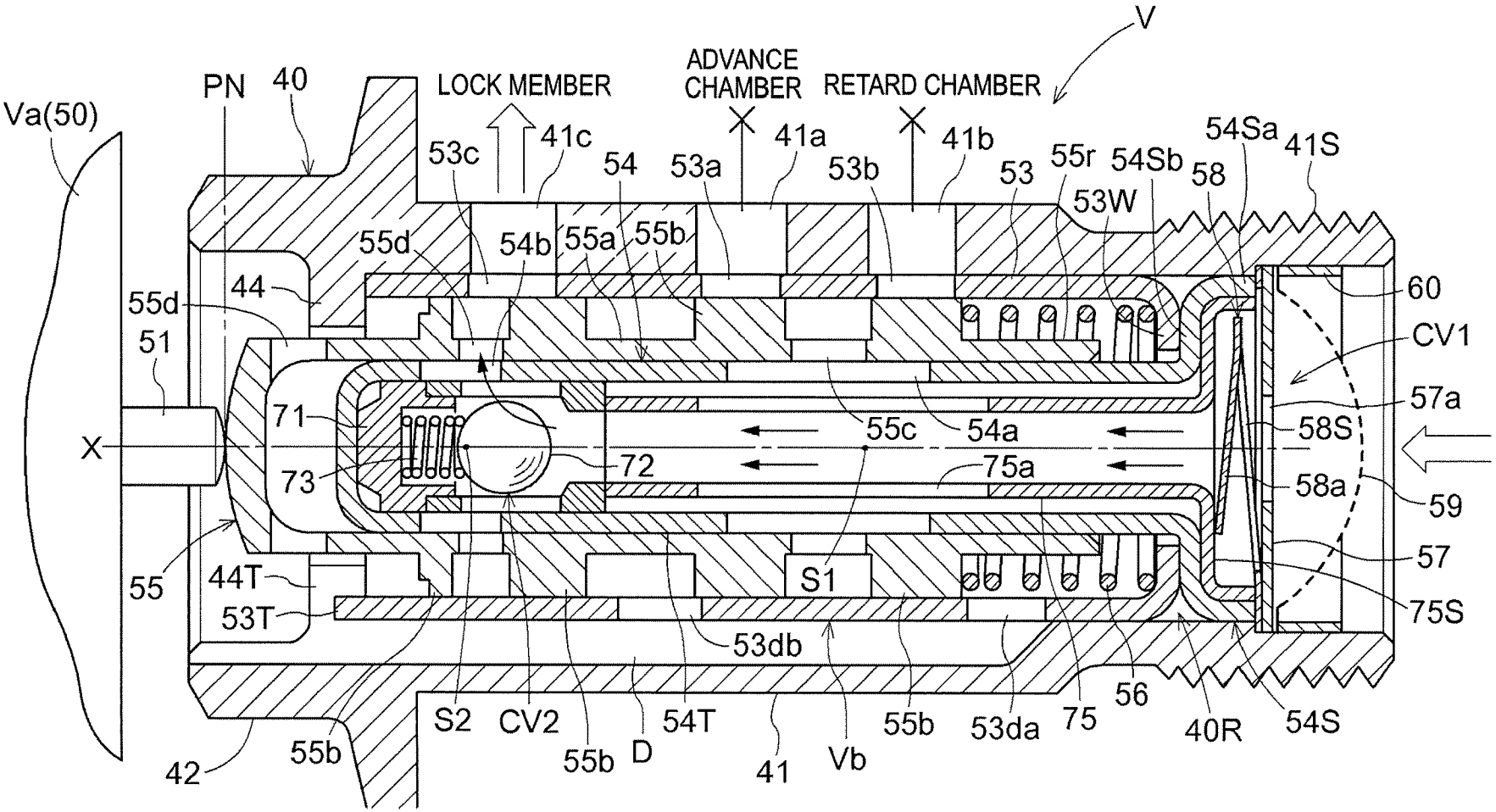
FIG. 6 is a sectional view of the valve unit in which the spool is positioned at a neutral position.

In a case where the spool 55 is operated to the neutral position PN, as shown in FIG. 6, the pair of land portions 55*b* close the advance communication holes 53*a* and the retard communication holes 53*b* of the sleeve 53, and the supply and discharge of the working oil with respect to the advance chambers Ca and the retard chambers Cb are interrupted to maintain the relative rotation phase.

In the neutral position PN, the working oil flows from the lock ports 41*c* to the lock recessed portions 27 via the lock control flow paths 35, the pressure of the working oil acts on the lock members 25, and the unlocked state of the lock mechanism L is continued.

In a case where the spool 55 is operated to any one of the second retard position PB2 and the first retard position PB1, the working oil supplied from the hydraulic pump P is fed to the retard ports 41*b* via the intermediate hole portions 55*c* of the spool 55 and the retard communication holes 53*b* and is supplied from the retard flow paths 34 to the retard chambers Cb. At the same time, the working oil in the advance chambers Ca flows from the advance flow paths 33 to the advance ports 41*a* and is discharged from the second drain holes 53*db* to the drain grooves D.

Figure 7:
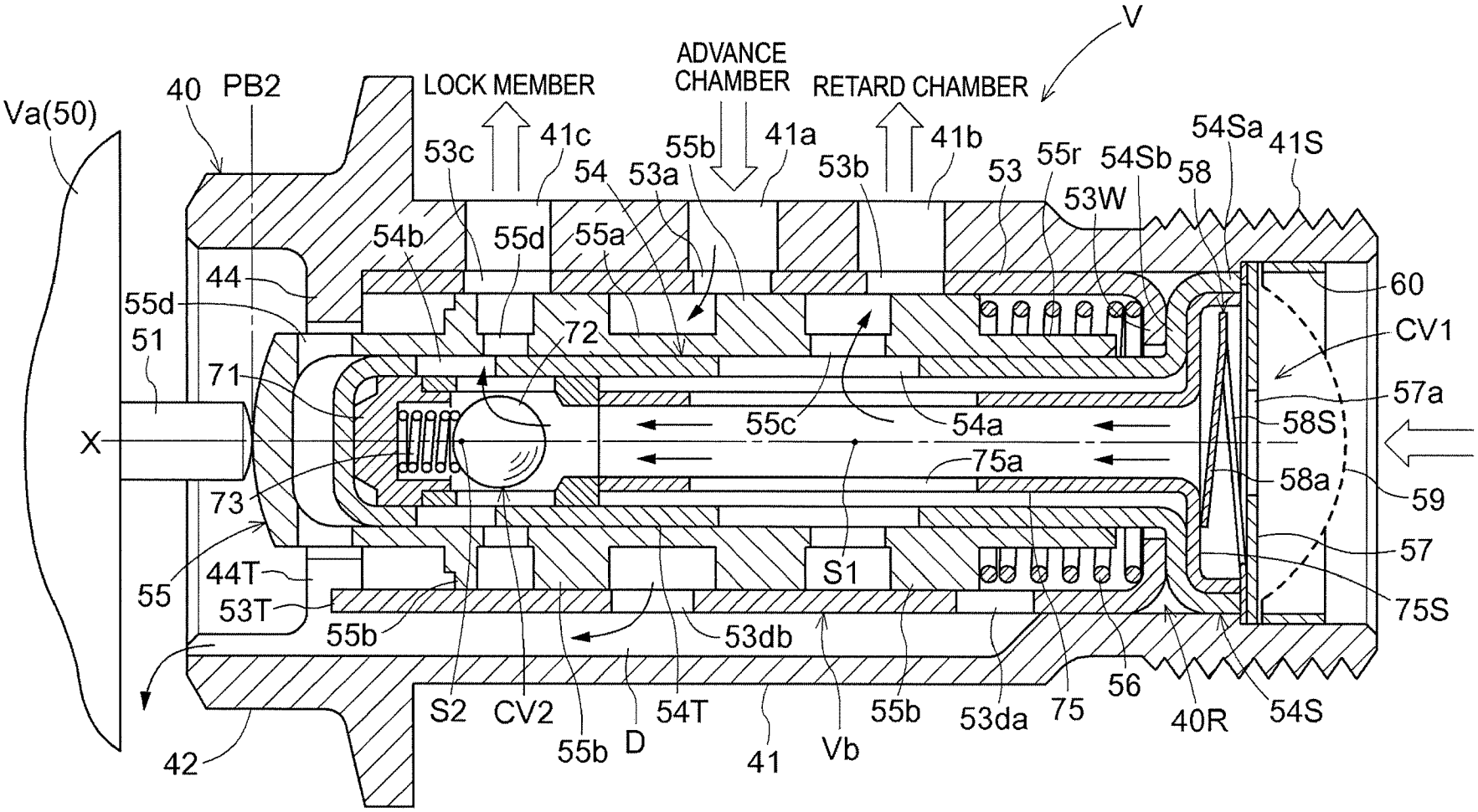
FIG. 7 is a sectional view of the valve unit in which the spool is positioned at a second retard position.

Particularly, in the second retard position PB2, as shown in FIG. 7, the working oil passes through the second check valve CV2 in conjunction with the supply of the working oil to the retard chambers Cb and is supplied from the lock ports 41*c* to the lock recessed portions 27 via the lock control flow paths 35. Accordingly, the pressure of the working oil continuously acts on the lock member 25, and the operation in the retard direction Sb is performed in a state where the lock mechanism L is unlocked.

Figure 8:
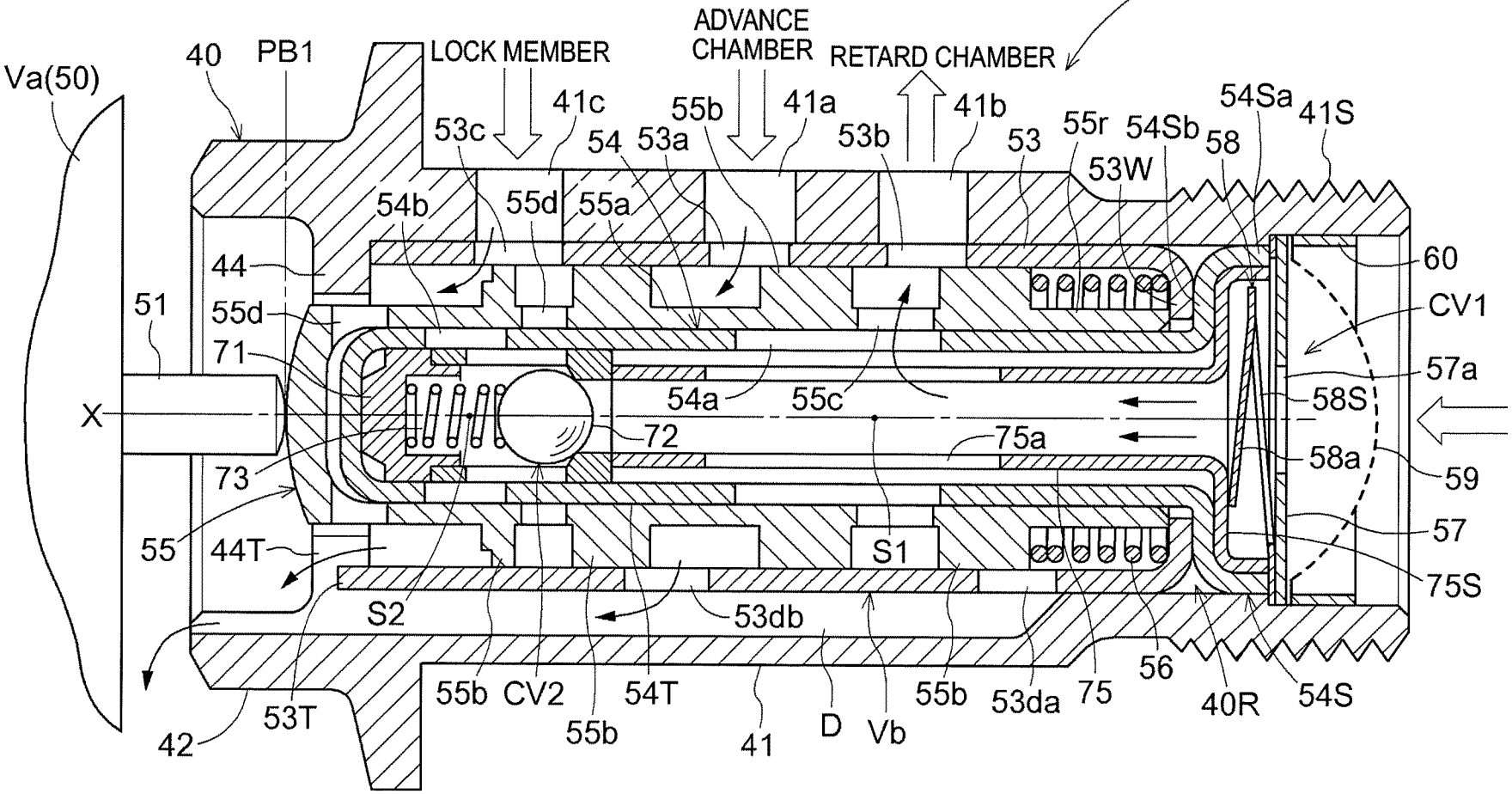
FIG. 8 is a sectional view of the valve unit in which the spool is positioned at a first retard position.

In the first retard position PB1, as shown in FIG. 8, the working oil in the lock recessed portions 27 flows from the lock control flow paths 35 to the lock ports 41*c* in conjunction with the supply of the working oil to the retard chambers Cb and is directly discharged from the outer end position of the spool 55 to the outer end side of the connecting bolt 40. According to the supply and discharge of the working oil, the lock mechanism L is shifted to the locked state when the relative rotation phase reaches the intermediate lock phase M while the relative rotation phase is displaced in the retard direction Sb.

The above-described configuration includes the second check valve CV2, and thus, when the pressure of the internal flow path decreases according to the operation of the spool 55 as in a case where the spool 55 is operated from the neutral position PN to the second advance position PA2 or the second retard position PB2, the locked state of the lock mechanism L is maintained by closing the second check valve CV2.

That is, in a situation where the pressure of the working oil acts on the lock ports 41*c*, the pressure in the internal flow path of the spool 55 decreases when the working oil is supplied to the advance ports 41*a* or the retard ports 41*b*, and thus, the fluid from the lock ports 41*c* flows to the internal flow path. However, the second check valve CV2 is closed by the pressure of the flow, the decrease in the pressure of the lock control flow paths 35 is prevented, and thus, it is possible to maintain the locked state of the lock mechanism L.

Operational Effects of Embodiment

In this way, the working oil in the internal flow path of the spool 55 is supplied to the advance chambers Ca, the retard chambers Cb, and the lock recessed portions 27, the working oil from each of these chambers and recessed portions can be discharged by the operation of the single spool 55, and thus, it is possible to decrease the size of the valve opening/closing timing control device A.

The working oil can be linearly supplied to the fluid supply pipe 54 along the rotation axis X, and thus, a pressure loss decreases, the working oil is supplied to the advance chambers Ca and the retard chambers Cb without decreasing the pressure, and high responsiveness is maintained. The opening portion 57*a* of the opening plate 57 of the first check valve CV1 is coaxially disposed with the rotation axis X, and thus, the first check valve CV1 does not act as a resistance to the oil passage.

Particularly, in this configuration, the advance ports 41*a*, the retard ports 41*b*, and the lock ports 41*c* are disposed to be close to each other. Accordingly, even when the pressure of the working oil acting on the lock ports 41*c* decreases as in a case where the spool 55 is operated from the neutral position PN to the second advance position PA2, the decrease in the pressure acting on the lock recessed portions 27 is prevented by closing the second check valve CV2, and the lock mechanism L is not shifted to the locked state.

The working oil discharged from the first drain holes 53*da* or the second drain holes 53*db* formed in the sleeve 53 is discharged from the head portion side of the connecting bolt 40 via the drain groove D which is the boundary between the outer surface of the sleeve 53 and the inner surface of the connecting bolt 40, and thus, the configuration of the drain flow path is simplified. Accordingly, the number of parts does not increase and the machining process is not complicated.

Other Embodiments

The embodiment disclosed here may be configured as follows in addition to the above-described embodiment (same reference numerals are assigned to configurations having the same functions as those of the embodiment).

(a) In order to hold the second check valve CV2 (lock holding check valve) at an appropriate position inside the fluid supply pipe 54, for example, a compression coil type spring or a material having a simple bar shape is used as the regulating member 75. According to this configuration, it is possible to hold the second check valve CV2 at an appropriate position.

(b) In order to hold the second check valve CV2 at an appropriate position, for example, the holding of the position can be performed to be fixed by caulking which applies pressure from the outside in a state where the second check valve CV2 is inserted inside the fluid supply pipe 54, or the holding of the position can be performed using a snap ring. An opening is formed at a portion of the fluid supply pipe 54 in which the second check valve CV2 is disposed, and the position of the second check valve CV2 can be held by fixing the second check valve CV2 by soldering in the opening.

(c) In the above-described embodiment, the spool 55 can be operated to the five positions. However, for example, the operation region is set such that any one of the first advance position PA1 and the first retard position PB1 does not exist, and thus, the spool 55 may be operated to four positions.

In a configuration in which the spool 55 is operated to the four positions without having the first advance position PA1, in a case where the state is shifted to the locked state in the intermediate lock phase M, the relative rotation phase may be set to the advance side from the intermediate lock phase M, and, by operating the spool 55 to the first retard position PB1, the state is shifted to the locked state while the relative rotation phase is displaced in the retard direction Sb.

(d) The second check valve CV2 is not limited to the configuration using the ball type valve member 72. That is, the second check valve CV2 may be configured as a reed type valve in which a plate-shaped valve member is elastically deformed to be opened and closed, a poppet type valve in which a columnar valve member slides to be opened and closed, or the like.

(e) Compared to the above-described embodiment, the valve unit Vb may be configured such that the dispositions of the advance ports 41*a* and the retard ports 41*b* are reversed and the dispositions of the advance communication holes 53*a* and the retard communication holes 53*b* are reversed.

The embodiment disclosed here can be used in a valve opening/closing timing control device which controls a relative rotation phase between a driving side rotator and a driven side rotator by a fluid pressure and holds the relative rotation phase at a predetermined phase by a lock mechanism.

A feature of an aspect of this disclosure resides in that valve opening/closing timing control device includes: a driving side rotator which synchronously rotates with a crankshaft of an internal combustion engine; a driven side rotator which is coaxially disposed with a rotation axis of the driving side rotator and integrally rotates with a valve opening/closing camshaft; an advance chamber and a retard chamber which are formed between the driving side rotator and the driven side rotator; a lock mechanism which includes a lock member capable of engaging with a recessed portion formed on one of the driving side rotator and the driven side rotator, and provided in the other of the driving side rotator and the driven side rotator; and a connecting bolt which is coaxially disposed with the rotation axis and connects the driven side rotator to the camshaft, in which the connecting bolt includes an internal space which is coaxially formed with the rotation axis, and an advance port communicating with the advance chamber, a retard port communicating with the retard chamber, and a lock port communicating with the recessed portion are formed as through-holes connecting the internal space and an outer periphery to each other, a valve unit is configured to accommodate a spool to be movable in a direction along the rotation axis in the internal space of the connecting bolt, and the spool includes an internal flow path through which a fluid is supplied about the rotation axis, and, in the spool, a lock holding check valve suppressing a backflow of a working oil from the lock port is disposed between a first supply point at which the fluid is capable of being supplied from the internal flow path to the advance port and the retard port and a second supply point at which the fluid is capable of being supplied to the lock port on a downstream side of the first supply point in a supply direction of the fluid.

According to this configuration, for example, in a case where the fluid in the internal flow path of the spool is supplied from the advance port to the advance chamber by operating the spool of the valve unit for operating the relative rotation phase in the advance direction, a fluid pressure in the internal space is decreased by the supply of the fluid, and the fluid tends to flow backward from the lock port to the internal space of the spool. In this way, in the case where the fluid tends to flow backward, the lock holding check valve is closed by a pressure caused by the backflow. Accordingly, the fluid does not flow from the lock port toward the internal space, and an unlocked state of the lock mechanism can be maintained.

Accordingly, the valve opening/closing timing control device is configured in which the lock mechanism is not shifted to the locked state when the relative rotation phase is controlled while the control of the relative rotation phase and the control of the lock mechanism are performed by controlling a fluid using the single spool.

As another configuration, a main check valve which prevents the backflow of the fluid from the internal space may be provided at a position inside the connecting bolt at which the supply of the fluid to the internal space starts.

According to this configuration, for example, in a case where the pressure in the internal space of the connecting bolt is temporarily decreased by cam change torque or the like when the working oil is supplied to the advance chamber, the main check valve is closed, and thus, an increase in the pressure does not act on the supply side of the fluid. Even in a case where the pressure of the flow path through which the fluid is supplied to the internal space of the connecting bolt temporarily decreases, the main check valve is closed, and thus, it is possible to prevent a decrease in the fluid pressure in the internal space.

As another configuration, a flow path cross-sectional area in a state where the main check valve is open may be set to be greater than a flow path cross-sectional area in a state where the lock holding check valve is open.

According to this configuration, it is possible to supply a sufficient amount of fluid via the main check valve in a case where the advance operation is performed. Even when the flow path cross-sectional area of the lock holding check valve is smaller than the flow path cross-sectional area of the main check valve, the locked state can be held, and it is possible to prevent an increase in a size of the lock holding check valve.

As another configuration, a regulating member determining a position of the lock holding check valve is disposed inside the spool and a base end portion of the regulating member is supported by the connecting bolt.

According to this configuration, the position of the lock holding check valve is determined by the regulating member. Particularly, in a case where the lock holding check valve is a united valve, a fluid pressure acts in a direction in which the lock holding check valve is displaced when the lock holding check valve is closed. However, the displacement is regulated by the regulating member, and thus, the lock holding check valve can be held at an appropriate position.

As another configuration, the valve opening/closing timing control device may further include a fluid supply pipe which is provided inside the spool, in which the lock holding check valve is fixed to the fluid supply pipe.

According to this configuration, the position of the lock holding check valve is determined by fixing the lock holding check valve to the fluid supply pipe. As means for fixing the lock holding check valve to the fluid supply pipe, press-fitting, screwing, caulking, welding, soldering, or the like with respect to the fluid supply pipe is considered. A portion of the fluid supply pipe is used as the lock holding check valve, and thus, a portion of the lock holding check valve can be integrally formed with the fluid supply pipe.

The principles, preferred embodiment and mode of operation of the present invention have been described in the foregoing specification. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

What is claimed is:

1. A valve opening/closing timing control device comprising:

a driving side rotator which synchronously rotates with a crankshaft of an internal combustion engine;

a driven side rotator which is coaxially disposed with a rotation axis of the driving side rotator and integrally rotates with a valve opening/closing camshaft;

an advance chamber and a retard chamber which are formed between the driving side rotator and the driven side rotator;

a lock mechanism which includes a lock member capable of engaging with a recessed portion formed on one of the driving side rotator and the driven side rotator, and provided in the other of the driving side rotator and the driven side rotator; and a connecting bolt which is coaxially disposed with the rotation axis and connects the driven side rotator to the camshaft, wherein the connecting bolt includes an internal space which is coaxially formed with the rotation axis, and an advance port communicating with the advance chamber, a retard port communicating with the retard chamber, and a lock port communicating with the recessed portion are formed as through-holes connecting the internal space and an outer periphery of the connecting bolt to each other, a valve unit is configured to accommodate a spool to be movable in a direction along the rotation axis in the internal space of the connecting bolt, the spool including an internal flow path through which a fluid is supplied in a supply direction of the fluid along the rotation axis, and, in the spool, a lock holding check valve suppressing a backflow of a working oil from the lock port to an internal space of the spool is disposed between a first supply point at which the fluid is capable of being supplied from the internal flow path to the advance port and the retard port and a second supply point at which the fluid is capable of being supplied to the lock port, the second supply point being downstream of the first supply point in the supply direction of the fluid along the rotation axis.

2. The valve opening/closing timing control device according to claim 1, wherein a main check valve which prevents the backflow of the fluid from the internal space is provided at a position inside the connecting bolt at which the supply of the fluid to the internal space starts.

3. The valve opening/closing timing control device according to claim 2, wherein a flow path cross-sectional area in a state where the main check valve is open is set to be greater than a flow path cross-sectional area in a state where the lock holding check valve is open.

4. The valve opening/closing timing control device according to claim 3, wherein a regulating member determining a position of the lock holding check valve is disposed inside the spool and a base end portion of the regulating member is supported by the connecting bolt.

5. The valve opening/closing timing control device according to claim 3, further comprising:

a fluid supply pipe which is provided inside the spool, wherein the lock holding check valve is fixed to the fluid supply pipe.

6. The valve opening/closing timing control device according to claim 2, wherein a regulating member determining a position of the lock holding check valve is disposed inside the spool and a base end portion of the regulating member is supported by the connecting bolt.

7. The valve opening/closing timing control device according to claim 2, further comprising:

a fluid supply pipe which is provided inside the spool, wherein the lock holding check valve is fixed to the fluid supply pipe.

8. The valve opening/closing timing control device according to claim 1, wherein a regulating member determining a position of the lock holding check valve is disposed inside the spool and a base end portion of the regulating member is supported by the connecting bolt.

9. The valve opening/closing timing control device according to claim 1, further comprising:

a fluid supply pipe which is provided inside the spool, wherein the lock holding check valve is fixed to the fluid supply pipe.

10. A valve opening/closing timing control device comprising:

a driving side rotator which synchronously rotates with a crankshaft of an internal combustion engine;

a driven side rotator which is coaxially disposed with a rotation axis of the driving side rotator and integrally rotates with a valve opening/closing camshaft;

an advance chamber and a retard chamber which are formed between the driving side rotator and the driven side rotator;

a lock mechanism which includes a lock member capable of engaging with a recessed portion formed on one of the driving side rotator and the driven side rotator, and provided in the other of the driving side rotator and the driven side rotator; and a connecting bolt which is coaxially disposed with the rotation axis and connects the driven side rotator to the camshaft, wherein the connecting bolt includes an internal space which is coaxially formed with the rotation axis, and an advance port communicating with the advance chamber, a retard port communicating with the retard chamber, and a lock port communicating with the recessed portion are formed as through-holes connecting the internal space and an outer periphery to each other, a valve unit is configured to accommodate a spool to be movable in a direction along the rotation axis in the internal space of the connecting bolt, the spool including an internal flow path through which a fluid is supplied in a supply direction of the fluid along the rotation axis, and, in the spool, a lock holding check valve suppressing a backflow of a working oil from the lock port is disposed between a first supply point of the internal flow path and a second supply point of the internal flow path downstream of the first supply point in the supply direction, the first supply point being a point at which the fluid is capable of being supplied from the internal flow path to the advance port and the retard port, the second supply point being a point at which the fluid is capable of being supplied from the internal flow path to the lock port while being blocked from fluid communication with the advance port or the retard port by the lock holding check valve when the lock holding check valve is closed.

11. The valve opening/closing timing control device according to claim 10, wherein a main check valve which prevents the backflow of the fluid from the internal space is provided at a position inside the connecting bolt at which the supply of the fluid to the internal space starts.

12. The valve opening/closing timing control device according to claim 11, wherein a flow path cross-sectional area in a state where the main check valve is open is set to be greater than a flow path cross-sectional area in a state where the lock holding check valve is open.

13. The valve opening/closing timing control device according to claim 12, wherein a regulating member determining a position of the lock holding check valve is disposed inside the spool and a base end portion of the regulating member is supported by the connecting bolt.

14. The valve opening/closing timing control device according to claim 12, further comprising:

a fluid supply pipe which is provided inside the spool, wherein the lock holding check valve is fixed to the fluid supply pipe.

15. The valve opening/closing timing control device according to claim 11, wherein a regulating member determining a position of the lock holding check valve is disposed inside the spool and a base end portion of the regulating member is supported by the connecting bolt.

16. The valve opening/closing timing control device according to claim 11, further comprising:

a fluid supply pipe which is provided inside the spool, wherein the lock holding check valve is fixed to the fluid supply pipe.

17. The valve opening/closing timing control device according to claim 10, wherein a regulating member determining a position of the lock holding check valve is disposed inside the spool and a base end portion of the regulating member is supported by the connecting bolt.

18. The valve opening/closing timing control device according to claim 10, further comprising:

a fluid supply pipe which is provided inside the spool, wherein the lock holding check valve is fixed to the fluid supply pipe.

* * * * *